United States Patent [19]

Nomura et al.

[11] Patent Number: 4,682,192

[45] Date of Patent: Jul. 21, 1987

[54] HEAT-SENSITIVE RECORDING SHEET

[75] Inventors: Masaharu Nomura, Yono; Hiroaki Tsugawa, Matsudo; Yukio Ishizaka, Tokyo; Hiroomi Hosoi, Urawa, all of Japan

[73] Assignee: Nippon Kayaku Kabushiki Kaisha, Tokyo, Japan

[21] Appl. No.: 757,366

[22] Filed: Jul. 22, 1985

[30] Foreign Application Priority Data

Jul. 31, 1984 [JP] Japan ..... 59-159235
Mar. 7, 1985 [JP] Japan ..... 60-43586

[51] Int. Cl.[4] ..... B41M 5/18

[52] U.S. Cl. ..... 503/200; 503/226; 427/152

[58] Field of Search ..... 346/200, 209, 226, 214; 427/150–152

[56] References Cited

U.S. PATENT DOCUMENTS 4,370,370 1/1983 Iwata et al. ..... 428/913
4,388,362 6/1983 Iwata et al. ..... 428/913

FOREIGN PATENT DOCUMENTS 0128349 10/1979 Japan ..... 346/226
0044687 4/1981 Japan ..... 346/226
0146794 11/1981 Japan ..... 346/226
0201692 12/1982 Japan ..... 346/226

OTHER PUBLICATIONS

*Hackh's Chemical Dictionary,* "Glass", p. 298.

*Primary Examiner*—Bruce H. Hess
*Attorney, Agent, or Firm*—Henry C. Nields

[57] ABSTRACT

A heat-sensitive recording sheet comprising:

(a) a support sheet;

(b) a thermo-sensitive color forming layer formed on the said support sheet, said thermo-sensitive color forming layer comprising a colorless to pale color leuco dye and an acidic material capable of coloring the colorless to pale color leuco dye when heat is applied thereto;

(c) an over-coat layer formed on the said heat-sensitive, color-forming layer, said over-coat layer comprising an inorganic silicate or a mixture of an inorganic silicate and a water-soluble, high-molecular compound or a slightly water-soluble high-molecular compound.

The said heat-sensitive recording sheet has a reduced property of sticking of coatings and/or dreg to a thermal head during recording and gives a developed image which is not faded by contact with plasticizer, oil, fat or water.

9 Claims, No Drawings

HEAT-SENSITIVE RECORDING SHEET

DETAILED DESCRIPTION OF THE INVENTION

The present invention relates to a heat-sensitive recording sheet and more particularly to a heat-sensitive recording sheet which has a reduced property of sticking of a coating and/or a dreg formed by degradation of the coating to a thermal head and gives a developed image having an excellent resistance to plasticizer, oil, fat or water.

Heat-sensitive recording sheets comprising a colorless or pale color leuco dye (hereinafter refer to as a leuco dye) and an acid material (hereinafter refer to as a developer) which can develop a colored image upon contact with the leuco dye on heating are described in Japanese patent publication Nos. 4160/1968 and 14039/1970 and are practically used in large quantities.

Generally, a heat-sensitive recording sheet is prepared by a process which comprises grinding a leuco dye and a developer, such as a phenolic compound or a carboxylic acid compound into a fine powder separately, mixing the ground dye with the ground developer, adding an assistant, such as a binder, a sensitizer, a filler or a lubricant to the resulting mixture to prepare a coating solution and applying the coating solution on a support, such as paper, film or synthetic paper. And a layer containing the leuco dye, the developer and others is called a heat-sensitive, color-forming layer. In such a heat-sensitive recording sheet, the leuco dye and/or the developer are melted by heating to cause the contact between the both. Therefore, the reaction between the leuco dye and the developer occurs to give a developed image, thus giving a record. Such a developed image is usually formed by the use of a thermal printer having a thermal head.

The heat-sensitive recording method has the following advantages: (1) no noise is generated during recording, (2) a developing or fixing treatment under wetting conditions is not necessary, (3) it is free of maintenance and (4) a thermal printer is relatively cheap. Therefore, it is widely used in the field of facsimiles, output of a computer, printers of desk computers, recorders of medical measurement, automatic ticket vending machines, heat-sensitive labels or the like.

However, the heat-sensitive recording sheet utilizing the combination of a leuco dye and a developer has the following disadvantages: (1) a coating and/or dreg stick to a thermal head during recording, and (2) the developed image is faded by contact with plasticizer, oil, fat or water.

It has been desired to develop a heat-senstitive recording sheet which does not cause sticking of the coating and dreg to a thermal head on heating for development of image and give a developed image which is not faded by contact with plasticizer, oil, fat or water.

The inventors of the present invention have investigated to overcome the above disadvantages of a heat-sensitive recording sheet and have found that the above disadvantages of a heat-sensitive recording sheet can be overcome by forming an over-coat layer (a protective layer) comprising an inorganic silicate or a mixture of an inorganic silicate and a water-soluble, high-molecular compound or a slightly water-soluble, high-molecular compound, particularly a mixture of an inorganic silicate and a self-crosslinking acrylic polymer on the heat-sensitive, color-forming layer. The present invention has been accomplished on the basis of this finding.

The inorganic silicates to be used in the present invention are water-insoluble colloidal inorganic silicates which can swell in water and disperse in a colloidal state. It is to be desired that an average particle size of water-insoluble collloidal inorganic silicates is below $1\mu$.

Examples of the water-insoluble colloidal inorganic silicate include colloidal aluminum silicates such as kaolin, kibushi clay and bentonite; colloidal magnesium silicates such as sepiolite; colloidal magnesium aluminum silicates such as attapulgite and fluorine-containing colloidal magnesium silicates such as dimonite.

Examples of the water-soluble, high-molecular compound include methylcellulose, methoxycellulose, hydroxyethylcellulose, carboxymethylcellulose, polyvinyl alcohol, carboxy-modified polyvinyl alcohols, polyvinylpyrrolidone, polyacrylamide, polyacrylic acid, starch and its derivatives, casein, gelatin, alkali salts of styrene-maleic anhydride copolymers and alkali salts of iso (or di-iso) butylene-maleic anhydride copolymers. Examples of the slightly water-soluble, high-molecular compound include polyvinyl acetate, vinyl chloride-vinyl acetate copolymers, polystyrene, polyacrylate, polyacrylamide, self-crosslinking acrylic polymer, polyurethane and stryene-butadiene-acrylic acid copolymers. In these examples of the slightly water-soluble, high-molecular compounds, a self-crosslinking acrylic polymer is more desirable.

In the present invention, emulsions obtained by copolymerizing, using an emulsifying agent, acrylic acid, methacrylic acid or their esters with a monomer such as styrene, vinylacetate, acrylonitrile, acrylamide, methacrylamide, maleic acid, itaconic acid or fumaric acid may be used as a self-crosslinking acrylic polymer. And, in the above-mentioned case, acrylic acid, methacrylic acid, maleic acid, itaconic acid and fumaric acid are used not only in the free acid but also in their salts such as ammmonium, Li, Na, K, Mg, Ca or Al salts.

Examples of the self-crosslinking acrylic polymer will be described wherein the term "alkyl" refers to those having at most 10 carbon atoms, such as methyl, ethyl, propyl, butyl or 2-ethylhexyl. Examples of the self-crosslinking acrylic polymer will be described as follows: Vinyl acetate-acrylic acid copolymers, vinyl acetate-methacrylic acid copolymers, vinyl acetate-alkyl acrylate copolymers, vinyl acetate-alkyl methacrylate copolymers, acrylonitrile-acrylic acid copolymers, acrylonitrile-acrylic acid-alkyl acrylate copolymers, acrylonitrile-alkyl methacrylate copolymers, acrylonitrile-methacrylic acid-alkyl acrylate-alkyl methacrylate-styrene copolymers, acrylonitrile-dialkylamino-alkyl methacrylate-acrylamide copolymers, acrylic acid-methacrylic acid copolymers, salts of acrylic acid-alkyl acrylate copolymers wth ammonium or metals (for example, Li, Na, K, Mg, Ca, or Al salt), acrylic acid-alkyl acrylate-acrylamide copolymers, acrylic acid-methacrylamide-styrene copolymers, methacrylic acid-alkyl acrylate-alkyl methacrylate copolymers, ammonium or metal salts of methacrylic acid-alkyl acrylate-alkyl methacrylate copolymers (for example, Li, Na, K, Mg, Ca or Al salt), methacrylic acid-alkyl acrylate-alkyl methacrylate-acrylamide copolymers, methacrylic acid-alkyl methacrylate copolymers, hydroxyethyl acrylate-acrylamide-styrene copolymers, alkyl acrylate-acrylamide-styrene copolymers, alkyl methacrylate-alkyl acrylate-maleic anhydride copolymers, methacrylic acid-alkyl acrylate-salts of maleic anhydride with ammonium or metals (for example, Li, Na, K, Mg, Ca, or Al salt) copolymers, alkyl acrylate-styrene-salts of maleic anhydride with ammonium or metals (for example, Li, Na, K, Mg, Ca, or Al salt) copolymers, alkyl methacrylate-fumaric acid copolymers, alkyl acrylate-salts of itaconic acid with ammonium or metals (for example, Li, Na, K, Mg, Ca, or Al salt) copolymers and their modified copolymers. (A preparation method for these self-crosslinking acrylic polymer is described in "Synthetic resin emulsion", Kōbunshi Kankoukai, 1978.1.30 or "Acrylic resin", Kōbunshi Kagaku Kankoukai, 1964.6.30)

Examples of the crosslinking reaction include reactions among carboxyl, hydroxyl, amino, epoxide, isocyanate, amide, N-methylolamide and aldehyde groups which are contained in the above-mentioned copolymer or in a crosslinking agent used as occasion demands. The inorganic silicate used in the present invention also serve as a crosslinking agent.

Molecular weight of the self-crosslinking acrylic polymer is 5,000 to 500,000, preferably, 100,000 to 300,000. When a colloidal inorganic silicate is used together with a water-soluble high-molecular compound or a slightly water-soluble, high molecular compound, the ratio of the colloidal inorganic silicate to them is generally between 1:0.1 and 1:10, preferably between 1:1 and 1:5 (by dry weight).

The over-coat layer according to the present invention can be formed by applying a coating solution which has been prepared either from the above colloidal inorganic silicate and water or from the above colloidal inorganic silicate and the water-soluble, high-molecular compound or the slightly water-soluble, high-molecular compound and, if necessary, water on the heat-sensitive color-forming layer and, if necessary, drying the resulting layer by heating. The thickness of this over-coat layer is 0.5 to 8μ, preferably 1 to 5μ. If it is less than 0.5μ, it will not be sufficient to prevent the coating and/or dreg form adhering to a thermal head during recording and the resistance to plasticizer, oil, fat or water will not be sufficiently improved. If it is more than 8μ, the development sensitivity on heating will be lowered.

If necessary, a crosslinking agent such as an epoxy compound (e.g., allyl glycidylether, butyl glycidylether, phenylglycidylether), a polyamine (e.g., m-phenylenediamine, m-xylylenediamine, m-tolylenediamine), a polyhydric alcohol (e.g., 1,4-butandiol, 1, 1, 1-trimethylolpropane, dihydroxybenzopropane), an aldehyde (e.g., glyoxal, paraformaldehyde), an isocyanated (e.g., tolylenediisocyanate, naphthylene-1,5-diisocyanate) or a polyvalent metal compound (e.g., aluminum-i-propionate, tetraisopropyltitanate, tetra-n-butoxy zirconium) may be added to the coating solution.

The heat-sensitive recording sheet on which the over-coat layer will be applied according to the present invention will be described. Such heat-sensitive recording sheets themselves have been known and are generally prepared by applying a liquid coating mixture comprising a leuco dye, a developer, a binder, if necessary, a filler and other additives on a support, such as paper, film, synthetic paper or the like. The weight of the liquid coating mixture to be applied on the support is, in general, 2–20 g/m$^2$ by dry weight. Now, examples of the leuco dye, the developer, the binder, the filler and the additives will be described.

Xanthenes, triarylmethanes, spiropyrans, diphenylmethanes, thiazines or the like are used as leuco dyes. Examples of the xanthenes include 2-anilino-3-methyl-6-diethylaminofluoran, 2-anilino-3-methyl-6-(methylcyclohexylamino)fluoran, 2-anilino-3-methyl-6-(ethylisopentylamino)fluoran, 2-anilino-3-methyl-6-dibutylaminofluoran, 2-(p-chloroanilino)-3 -methyl-6-diethylaminofluoran, 2-(p-fluoranilino)-3-methyl-6-diethyl-aminiofluoran, 2-anilino-3-methyl-6-(p-toluidinoethylamino) fluoran, 2-(p-toluidino)-3-methyl-6-diethylaminofluoran, 2-(o-chloroanilino)-6-dibutylaminofluoran, 2-(o-fluoranilino)-6-diethylamino-fluoran, 2-(o-fluoroanilino)-6-dibutylamino-fluoran, 2-anilino-3-methyl-6-piperidinofluoran, 2-anilino-3-methyl-6-pyrrolidinofluoran, 2-ethoxyethylamino-3-chloro-6-diethylaminofluoran, 2-anilino-3-chloro-6-diethylaminofluoran, 2-chloro-6-diethylaminofluoran and 2-methyl-6-diethylaminofluoran. Examples of the triarylmethane include 3,3-bis (p-dimethylaminophenl)-6-dimethylaminophthalide(crystal violet lactone), 3,3-bis(p-dimethylaminophenyl)phthalide and 3-(p-dimethylaminophenyl)-3-(1,2-dimethylaminoindol-3-yl)phthalide. Examples of the spiropyrans include 3-methyl-3-spirodinaph-thopyran and 1,3,3-trimethyl-6'-nitro-8'-methoxyspiro(indoline-2,2'-benzopyran). Example of the diphenylmethanes include N-halophenal-leucoauramine. Example of the thiazines include benzoyl leucomethylene blue. These leuco dyes are used alone or as a mixture thereof.

Examples of the developer include p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)-cyclohexane, 4,4'-thiobisphenol, 4,4'-sulfonydiphenol, bis-(3-allyl-4-hydroxphenyl) sulfone, phenolic novolak resins, benzyl-p-hydroxybenzoate, ethyl-p-hydroxybenzoate, dimethyl-4-hydroxyphthalate, ethyl-5-hydroxyisophathalate, 3,5-di-tert-butylsalicylic acid and 3,5-di-α-methylbenzylsalicylic acid. Further, polyvalent metal salts of the above aromatic carboxylic acids can be used as the developer.

Examples of the binder include water-soluble ones such as methylcellulose, methoxycellulose, hydroxyethylcellulose, carboxymethylcellulose, polyvinyl alcohol, carboxyl group-modified polyvinyl alcohols, polyvinylpyrrolidone, polyacrylamide, polyacrylic acid, starch and its derivatives, casein, gelatin, alkali salts of styrene-maleic anhydride copolymers and alkali salts of iso(or diiso)butylene-maleic anhydride copolymers and emulsions of a water-insoluble polymer such as polyvinyl acetate, vinyl chloride-vinyl acetate copolymers, polystyrene, polyethyl acrylate, polyurethane, styrene-butadiene-acrylic acid copolymers and self-crosslinking acrylic polymers.

Examples of the filler may include calcium carbonate, magnesium carbonate, magnesium oxide, silica, white carbon, talc, clay, alumina, magnesium hydroxide, aluminum oxide, barium sulfate, polystyrene resins and urea-formalin resins.

In general, the heat-sensitive color forming layer is prepared so that the leuco dye, the developer and the binder may be contained therein in the ratio of 1 to 20 parts:1–90 parts: 1–60 parts (the lueco dye: the developer: the binder).

As the other additives, lubricants, such as zinc stearate, calcium stearate or aluminum stearate, various surfactants, anti-foam agents or the like may be added at need.

Further, papers, synthetic paper, films or the like are used as the support on which the heat-sensitive, color-forming layer will be formed.

The heat-sensitive recording sheet according to the present invention can be widely used in the fields of facsmiles, output of computers, printers of desk computers or the like, recorders for medical measurement, automatic ticket vending machines, heat-sensitive labels or the like. Further, a magnetic recording layer can be formed on the surface of the support opposite the heat-sensitive, color-forming layer and the resulting sheet can be used in the fields of magnetic recording tickets or cards.

The present invention will be described by the following Examples in more detail.

EXAMPLE 1

A mixture comprising the following composition was ground and dispersed separately by the use of a sand grinder to prepare liquids [A] to [C] having an average particle size of 1 to 3μ.

| | | |
|---|---|---|
| liquid [A] | 2-(o-fluoroanilino)-6-diethylaminofluoran | 25 parts |
| | 25% aqueous solution of PVA | 20 |
| | water | 55 |
| liquid [B] | bis(3-allyl-4-hydroxy phenyl) sulfone | 12.7 |
| | 25% aqueous solution of PVA | 16 |
| | water | 71.3 |
| liquid [C] | p-acetotoluidide | 12.7 |
| | calcium carbonate | 21.3 |
| | 25% aqueous solution of PVA | 16 |
| | water | 50 |

Liquids [A], [B] and [C] were mixed in the ratio of 6:47:47 to prepare a coating solution. The liquid was applied on a high quantity paper of the basis weight of about 50g/m$^2$ with a dry solid content of 10 g/m$^2$ and dried to obtain a heat-sensitive recording paper. Then, a coating solution obtained by mixing 5% aqueous suspension of water-containing colloidal magnesium aluminum silicate $(OH)_4Si_8(Al_{3.34}Mg_{0.66})\ O_{20}Na_{0.66}$, (Kunipia-F., a product of Kunimine Industrial Co., Ltd.) with a self-crosslinking acrylic emulsion comprising ammonium methacrylate-ethyl acrylate-methyl methacrylate (1:1:1) copolymer (molecular weight (MW): about 200,000) with a dry weight ratio of 1 to 5 was applied on the heat-sensitive, color-forming layer and dried to give a heat-sensitive recording sheet (paper) having an over-coat of a dry thickness of 2μ.

EXAMPLE 2

The same procedure as the one described in Example 1 was repeated except that fluorine-containing colloidal magnesium silicate, $NaMg_{2.5}Si_4O_{10}F_2$, (Dimonite: a product of Topy Industrial Co., Ltd.) was used instead of water-containing colloidal aluminum silicate used in Example 1 to obtain a heat-sensitive recording sheet (paper) having an over-coat layer.

EXAMPLE 3

The same procedure as the one described in Example 1 was repeated except that a mixture obtained by mixing 5% aqueous suspension of water-containing colloidal aluminum silicate with a self-crosslinking acrylic emulsion comprising ammonium methacrylate-butyl acrylate-methyl methacrylate (1:1:1) copolymer (MW: about 250000) with a solid weight ratio of 1 to 3 was used as a coating solution and that the thickness of the over-coat was 3μ to obtain a heat-sensitive recording sheet (paper) of the present invention.

EXAMPLE 4

The same procedure as the one described in Example 1 was repeated except that a mixture obtained by mixing 5% aqueous suspension of fluorine-containing colloidal magnesium silicate (Dimonite) with a self-crosslinking acrylic emulsion comprising an ammonium methacrylate-methyl acrylate-methyl methacrylate (2:1:1) copolymer (MW. about 270,000) with a dry weight ratio of 1 to 1 was used and that the thickness of the over-coat was 3μ to obtain a heat-sensitive sheet (paper) of the present invention.

EXAMPLE 5

The same procedure as the one described in Example 1 was repeated except that a mixture obtained by mixing the same self-crosslinking acrylic emulsion as the one used in Example 1 with the same self-crosslinking acrylic emulsion as the one used in Example 4 and a water-containing colloidal aluminum silicate, $(OH)_4Si_8(Al_{3.34}Mg_{0.66})O_{20}Na_{0.66}$ (Kunipa G: a product of Kunimine Industrial Co., Ltd.) with a solid weight ratio of 1:1:1 was used and that the thickness of the over-coat was 3μ to obtain a heat-sensitive recording sheet (paper) of the present invention.

EXAMPLE 6

A mixture having the following composition was ground and dispersed by the use of a sand grinder to obtain liquids [A] to [C] having an average particle size of 1 to 3μ.

| | | |
|---|---|---|
| liquid [A] | 2-analino-3-methyl-6-diethylaminofluoran | 25 parts |
| | 25% aqueous solution of PVA | 20 |
| | water | 55 |
| liquid [B] | bis(3-allyl-4-hydroxyphenyl) sulfone | 12.7 |
| | 25% aqueous solution of PVA | 16 |
| | water | 71.3 |
| liquid [C] | p-acetotoluidide | 12.7 |
| | calcium carbonate | 21.3 |
| | 25% aqueous solution of PVA | 16 |
| | water | 50 |

Then, liquids [A], [B] and [C] were mixed in the ratio 6:47:47 to prepare a coating solution. The coating solution was applied on a high-quality paper of a basis weight of about 50 g/m$^2$ with a dry solid content of 10 g/m$^2$ and dried.

Then, a 5% aqueous suspension of water-containing colloidal aluminum silicate (Kunipia-F: a product of Kunimine Industrial Co., Ltd.) was applied on the heat-sensitive, color-forming layer to obtain a heat-sensitive recording sheet (paper) having an over-coat of a dry thickness of 2μ.

EXAMPLE 7

The same procedure as the one described in Example 6 was repeated except that a 5% aqueous suspension of fluorine-containing colloidal magnesium silicate (Dimonite) was used instead of water-containing colloidal aluminum silicate to prepare a heat-sensitive recording sheet (paper) of the present invention.

EXAMPLE 8

The same procedure as the one described in Example 6 was repeated except that a mixture obtained by mixing water-containing colloidal aluminum silicate (Kunipia F) with polyvinyl alcohol with a solid weight ratio of 1:1 was applied and that the thickness of the over-coat layer was 3μ.

EXAMPLE 9

The same procedure as the one described in Example 6 was repeated except that a mixture obtained by mixing a 5% aqueous suspension of a fluorine-containing colloidal magnesium silicate (Dimonite) with polyvinyl alcohol with a solid weight ratio of 1:1 was applied to obtain a heat-sensitive recording sheet (paper) of the present invention.

EXAMPLE 10

The same procedure as the one described in Example 6 was repeated except that a mixture obtained by mixing water-containing colloidal silicate (Dimonite) with methyl methacrylate polymer (MW: about 270,000) with a solid weight ratio oif 1:5 was applied and that the thickness of the over-coat layer was 3μ, to obtain a heat-sensitive recording sheet (paper) of the present invention.

EXAMPLES 11 22

A coating solution was prepared by the use of a self-crosslinking acrylic emulsion and a colloidal inorganic silicate which are shown in Table and applied on the heat-sensitive, color-forming layer prepared by the same procedure as that of Example 6 to obtain a heat-sensitive recording sheet (paper) of the present invention.

The heat-sensitive recording sheet having an over-coat layer exhibited reduced property of sticking of the coating an/or dreg to the thermal head and gave a developed image which is not faded by contact with plasticizer, oil, fat or water.

DEVELOPMENT TEST AND COMPARATIVE TEST

The heat-sensitive recording sheets of the present invention obtained in Examples 1 to 10, a basic heat-sensitive recording sheet having no over-coat layer (Comparative Example 1), a heat-sensitive recording sheet on which the same self-crosslinking emulsion as the one used in Example 1 (containing ammonium methacrylate-ethylacrylate-methyl methacrylate (1:1:1) copolymer) had been applied to form an over-coat layer of a thickness of 2μ (Comparative Example 2) and a heat-sensitive recording sheet on which polyvinyl alcohol had been applied to form an over-coat layer of a thickness of 2μ (Comparative Example 3) were examined for characteristics. The results are shown in the following Table.

| | Development test | | |
|---|---|---|---|
| | Color density | Sticking of the coating and/or dreg to a thermal head | Resistance to plasticizer % |
| Comparative Ex. | | | |
| 1 | 1.33 | observed | 45 |
| 2 | 1.33 | observed | 60 |
| 3 | 1.33 | observed | 80 |
| Ex. | | | |
| 1 | 1.32 | not observed | 98 |
| 2 | 1.32 | not observed | 99 |
| 3 | 1.31 | not observed | 99 |
| 4 | 1.30 | not observed | 98 |
| 5 | 1.30 | not observed | 99 |
| 6 | 1.31 | not observed | 98 |
| 7 | 1.30 | not observed | 98 |
| 8 | 1.30 | not observed | 99 |
| 9 | 1.32 | not observed | 98 |
| 10 | 1.33 | not observed | 99 |

| Example No. | Self-crosslinking emulsion (A) | Colloidal inorganic silicate (B) | (B):(A) (solid weight ratio) | Thickness (μ) of the over-coat layer |
|---|---|---|---|---|
| 11 | methacrylic acid-ethyl acrylate-ammonium salt of maleic anhydride (1:1:1) copolymer (MW: about 280,000) | Kunipia G | 1:4 | 4 |
| 12 | acrylonitrile-acrylic acid-ethyl acrylate (1:2:2) copolymer (MW: about 260,000) | Kunipia G | 1:3 | 3 |
| 13 | methacrylic acid-methyl methacrylate-ammonium salt of maleic anhydride (1:2:2) copolymer (MW: about 240,000) | Kunipia G | 1:4 | 4 |
| 14 | methyl methacrylate-fumaric acid (1:1) copolymer (MW: about 300,000) | Dimonite | 1:2 | 3 |
| 15 | acrylic acid-methacrylamide-styrene (1:1:1) copolymer (MW: about 250,000) | Dimonite | 1:3 | 3 |
| 16 | vinyl acetate-methyl methacrylate (1:1) copolymer (MW: about 300,000) | Kunipia F | 1:1 | 3 |
| 17 | ethyl acrylate-ammonium itaconate (1:2) copolymer (MW: about 200,000) | Kunipia F | 1:3 | 3 |
| 18 | methyl acrylate-styrene-ammonium salt of maleic anhydride (2:1:2) copolymer (MW: about 350,000) | Kunipia F | 1:4 | 3 |
| 19 | methacrylic acid-butyl acrylate-ammonium salt of maleic anhydride (1:2:3) copolymer (MW: about 180,000) | Kunipia F | 1:3 | 3 |
| 20 | acrylonitrile-acrylic acid (1:1) copolymer (MW: about 250,000) | Kunipia F | 1:3 | 3 |
| 21 | ammonium methacrylate-2-ethyl hexyl acrylate-methyl methacrylate (2:3:1) copolymer (MW: about 200,000) | Kunipia G | 1:3 | 3 |
| 22 | ammonium methacrylate-ethyl acrylate-butyl acrylate-methyl methacrylate (1:1:1:1) copolymer (MW: about 220,000) | Kunipia G | 1:3 | 3 |

COLOR DENSITY

The density of a color developed by pressing the recording sheet at 140° C. for 5 seconds with a hot plate was measured with a Macbeth reflection densitometer RD-914.

STICKING OF THE COATING AND/OR DREG

The coating and/or dreg sticking to a thermal head after printing had been carried out with an OKIFAX 7800 (Oki Electric Co., Ltd.) for a fixed time was observed with the naked eye.

RESISTANCE TO PLASTICIZER

After the developed heat-sensitive recording paper which was between films made of polyvinyl chloride and in contact with the films under a pressure of about 20 g/cm$^2$ had been allowed to stand at room temperature for 7 days, the density of the image was measured and the ratio of this density to the one before the standing is shown.

It is clear from the above test that the heat-sensitive recording sheet of the present invention exhibits reduced property of sticking of the coating and/or dreg to a thermal head and an enhanced resistance to plasticizer as compared with the ones of the prior art, without any decrease in color density.

What we claim is:

1. A heat-sensitve recording sheet comprising:

(a) a support sheet;

(b) a thermo-sensitive color forming layer formed on the said support sheet, said thermo-sensitive color forming layer comprising a colorless to pale color leuco dye and an acidic material capable of coloring the colorless to pale color lueco dye when heat is applied thereto;

(c) an over-coat layer formed on the said heat-sensitive, color-forming layer, said over-coat layer comprising a colloidal inorganic silicate selected from the group consisting of colloidal magnesium aluminum silicates and fluorine-containing colloidal magnesium silicates or a mixture of the said colloidal inorganic silicate and a water-soluble, high-molecular compound or a slightly water-soluble high-molecular compound.

2. A heat-sensitive recording sheet, according to claim 1 wherein the over-coat layer comprises the said colloidal inorganic silicate and a slightly water-soluble, high-molecular compound.

3. A heat-sensitive recording sheet, according to claim 2, wherein the slightly water-soluble high molecular compound is a self-crosslinking acrylic polymer.

4. A heat-sensitive recording sheet, according to claim 3, wherein the self-crosslinking acrylic polymer is an emulsion obtained copolymerizing acrylic acid, methacrylic acid or their esters with styrene, vinylacetate, acrylonitrile. acrylamide, methacrylamide, maleic acid, itaconic acid or fumaric acid.

5. A heat-sensitive recording sheet, according to claim 2, wherein the thickness of the over-coat layer is 0.5 to 8$\mu$.

6. A heat-sensitive recording sheet, according to claim 2, wherein the ratio of the colloidal inorganic silicate to the slightly water-soluble high-molecular compound is between 1:1 and 1:5 by dry weight.

7. A heat-sensitve recording sheet, according to claim 1, wherein the colloidal inorganic silicate is bentonite.

8. A heat-sensitive recording sheet, according to claim 1 wherein the colloidal inorganic silicate is an attapulgite.

9. A heat-sensitve recording sheet, according to claim 1 wherein the colloidal inorganic silicate is a dimonite.

* * * * *